United States Patent [19]

Amann et al.

[11] 4,105,230

[45] Aug. 8, 1978

[54] CLOSURE FOR PIVOTAL FLAPS, COVERS, OR THE LIKE

[75] Inventors: Rolf Amann, Renningen; Hans Benda, Aidlingen; Albert Dietterle, Böblingen, all of Fed. Rep. of Germany

[73] Assignee: Daimler-Benz Aktiengesellschaft, Fed. Rep. of Germany

[21] Appl. No.: 663,565

[22] Filed: Mar. 3, 1976

[30] Foreign Application Priority Data

Mar. 4, 1975 [DE] Fed. Rep. of Germany ..... 2509299

[51] Int. Cl.[2] ..... E05C 5/00

[52] U.S. Cl. ..... 292/202

[58] Field of Search ..... 292/67, 87, 114, 128, 292/202, 244, 228

[56] References Cited

U.S. PATENT DOCUMENTS

| | | | |
|---|---|---|---|
| 375,528 | 12/1887 | Beecher | 292/242 |
| 836,810 | 11/1906 | Kapus | 292/67 |
| 849,207 | 4/1907 | Cox | 292/128 |
| 1,301,814 | 4/1919 | Burk | 292/228 |
| 2,676,824 | 4/1954 | Gessler | 292/67 |
| 2,873,880 | 2/1959 | Poulos | 292/87 X |
| 3,005,065 | 10/1961 | Jellies | 292/DIG. 69 |
| 3,797,871 | 3/1974 | Morishita | 292/87 X |

*Primary Examiner*—Richard E. Moore

*Attorney, Agent, or Firm*—Craig & Antonelli

[57] ABSTRACT

A lock for pivotal flaps, covers, or the like, especially for glove compartments in motor vehicles, with a curved locking member preferably rotatably supported at a pivotal part against the force of a spring, which in the locking position cooperates with its free end with a fixed locking member. The cooperating ends of the two locking members, as a result of an approximately rectangularly bent-off configuration in the form of an "L" or "U" effect a horizontal and vertical inter-engagement so that a mutual support in these two directions does not permit a disengagement of the ends of the locking members either in the upward or an opening direction of the pivotal flap.

13 Claims, 2 Drawing Figures

CLOSURE FOR PIVOTAL FLAPS, COVERS, OR THE LIKE

The present invention relates to a lock for pivotal flaps, covers or the like, especially for glove compartments in motor vehicles, with a curved locking member preferably rotatably supported at a pivotal part against the force of a spring, which in the locking position cooperates with its free end with a fixed locking member.

The present invention is concerned with the task to construct with means that are simple from a structural and manufacturing point of view a locking device for pivotal flaps, covers or the like in such a manner that a disengagement of the locking parts as a result of deformations, for example, as a result of an accident or force-influence, can be far-reachingly prevented, and that, furthermore, a closing and locking of the flap or the like is possible in a simple manner.

The underlying problems are solved according to the present invention in that the cooperating ends of both locking members effect a horizontal and vertical interlocking engagement owing to an approximately rectangularly bent portion in the form of an "L" or "U" so that the mutual support in these two directions does not permit a separation of the ends of the locking members either in the upward or in the rearward direction.

According to a feature of the present invention, at least one of the two locking parts includes an inclined slide surface which enables a simple pressing shut of the flap.

Accordingly, it is an object of the present invention to provide a lock for pivotal flaps, covers or the like which avoids by simple means the aforementioned shortcomings and drawbacks encountered in the prior art.

Another object of the present invention resides in a lock for pivotal flaps, covers or the like which is structurally simple and involves no difficulties from a manufacturing point of view.

A still further object of the present invention resides in a closure mechanism for pivotal flaps, covers or the like which is so constructed that an inadvertent opening as a result of deformations caused by accidents and the like can be far-reachingly avoided.

Still another object of the present invention resides in a lock of the type described above which makes it possible to close the flap, covers or the like in a simple manner.

Another object of the present invention resides in a lock for pivotal flaps, covers or the like, which permits a simple closing, for example, of the glove compartment by merely pressing the flap or cover into its closed position.

Figure 1:
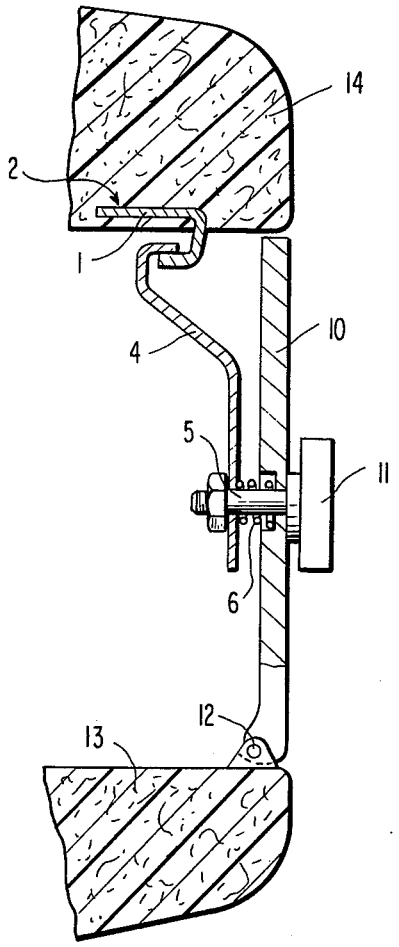
Figure 2:
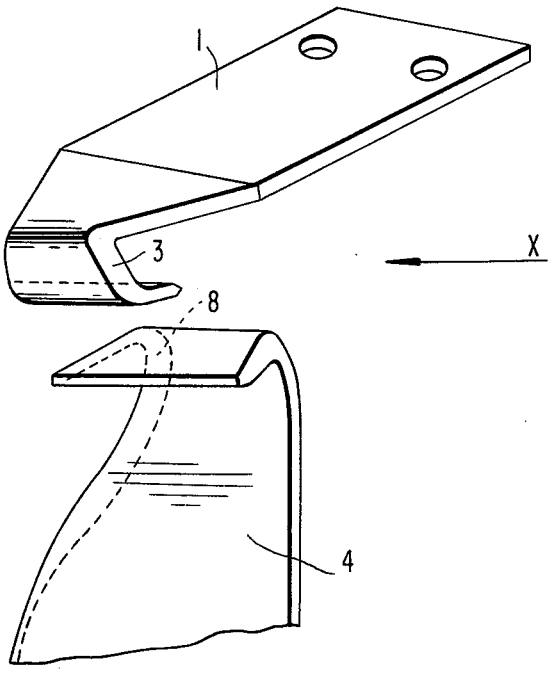

These and other objects, features and advantages of the present invention will become more apparent from the following description when taken in connection with the accompanying drawing which shows, for purposes of illustration only, one embodiment in accordance with the present invention, and wherein:

FIG. 1 is a vertical cross-sectional view through a glove compartment of a motor vehicle in accordance with the present invention in the closed position thereof; and FIG. 2 is a somewhat schematic, simplified perspective view of the locking members prior to the closing operation corresponding to FIG. 1 as viewed from above and in front thereof.

Referring now to the drawing wherein like reference numerals are used throughout the two views to designate like parts, and more particularly to FIG. 1, this figure shows a bent-off locking member 1 which is locally fixedly mounted above the glove compartment at 2 within the area of the upper cover means 14 thereof. The free end of the locking member 1 is constructed approximately L-shaped. In the locking position, the free end of the locking member 1 is engaged from behind by the free end of a curved locking member 4 also constructed approximately L-shaped. The curved locking member 4 is rotatably supported at a flap 10 about a shaft 5 on which is also arranged a handle 11 with a spring 6 for purposes of opening the flap. The flap 10 is pivotally supported at 12 at the lower cover means 13 of the glove compartment.

FIG. 2 illustrates the fixed locking member 1 having an inclined slide surface 3 prior to the closing and latching operation. The curved locking member 4 is provided with a complementary inclined slide surface 8, whereby the inclined slide surface 3 is inclined toward the left in FIG. 2 and the inclined slide surface 8 is inclined toward the right. It is achieved by this type of construction utilizing the inclined slide surfaces 3 and 8 that during the closing operation, i.e., when the flap 10 of the glove compartment is pressed shut, the free end of the rotatably supported curved locking member 4 slides with its inclined slide surface 8 along the inclined slide surface 3 of the fixed locking member 1, whereby the curved member 4 necessarily rotates on the shaft 5 (FIG. 1) against the force of the spring 6 which seeks to hold the curved locking member 4 in the direction of arrow "X". As soon as the inclined slide surface 3 is overcome, the spring 6 pulls the curved locking member 4 into its original position in the direction of arrow "X" and the approximately L-shaped free ends of the two locking members 1 and 4 latch with one another by engagement of the free end of the curved locking member 4 from behind with the free end of the fixed locking member 1 whereby the member 4 abuts in the locking position at an abutment (not shown).

The curved locking member 4 can be pivoted out of this locked position against the force of spring 6 in a direction opposite the direction of arrow "X" by rotation of knob 11, the interengagement of the two locking members 1 and 4 is released thereby and the unlocked flap 10 can now be opened.

While we have shown and described only one embodiment in accordance with the present invention, it is understood that the same is not limited thereto but is susceptible of numerous changes and modifications as known to those skilled in the art, and we therefore do not wish to be limited to the details shown and described herein but intend to cover all such changes and modifications as are encompassed by the scope of the appended claims.

We claim:

1. A lock for a pivotal member, the lock comprising a curved locking member cooperating with a free end in a locking position with a free end of a fixed locking member, characterized in that the cooperating free ends of the two locking members have an approximately rectangularly bent configuration and effect upon a displacement of the pivotal member to a locking position a substantially horizontal and a substantially vertical interengagement in such a manner that a mutual support in the horizontal and vertical directions precludes a disengagement of the free ends of the locking members either in an upward direction with respect to the fixed locking member or in an opening direction of the pivotal member, the curved locking member engages with a bent-off free end with the free end of the fixed locking member from behind the fixed locking member, the curved locking member is rotatably supported at a pivotal part against the force of a spring normally urging said curved locking member into the locking position, and in that at least one of the two locking members includes an inclined slide surface means along a lateral edge thereof which cooperates with an adjacent lateral edge of the other of the two locking members so as to enable a locking of the two locking members by a simple pressing closed of the pivotal member.

2. A lock according to claim 1, in a glove compartment of a motor vehicle, characterized in that the pivotal member is a flap or cover for the glove compartment.

3. A lock according to claim 1, characterized in that the free end of at least one of the locking members has an approximately "L"-shaped configuration.

4. A locking mechanism according to claim 1, characterized in that at least one of the locking members has an approximately "U"-shaped configuration.

5. A lock for a pivotal member, the lock comprising a curved locking member cooperating with a free end in a locking position with a free end of a fixed locking member, characterized in that the cooperating free ends of the two locking members have an approximately rectangularly bent configuration and effect upon a displacement of the pivotal member to a locking position a substantially horizontal and a substantially vertical interengagement in such a manner that a mutual support in the horizontal and vertical directions precludes a disengagement of the free ends of the locking members either in an upward direction with respect to the fixed locking member or in an opening direction of the pivotal member, and in that at least one of the two locking members includes an inclined slide surface means along a lateral edge thereof which cooperates with an adjacent lateral edge of the other of the two locking members so as to enable a simple pressing closed of the pivotal member.

6. A lock according to claim 5, characterized in that both locking members include inclined slide surface means arranged on adjacent lateral edges of the respective locking members.

7. A lock according to claim 5, characterized in the free end of each of the locking members has an approximately "L"-shaped configuration.

8. A locking mechanism according to claim 5, characterized in one of the locking members has an approximately "U"-shaped configuration.

9. A lock according to claim 5, characterized in that the curved locking member is rotatably supported at a pivotal part against the force of a spring normally urging said curved locking member into the locking position.

10. A lock for a pivotal member comprising:

a first locking member rotatably mounted on the pivotal member, said first locking member including a locking end having an approximately rectangularly bent configuration, a second locking member fixedly mounted at a support surface, said second locking member including a locking end having an approximately rectangularly bent configuration, means arranged at the pivotal member for normally biasing the first locking member into a locking position, the locking ends of each of the first and second locking members include lateral edges which are brought into engagement upon a closing of the pivotal member, one of the lateral edges of at least one of the first and second locking members being configured so that during a closing of the pivotal member said lateral edge first rotatably displaces said first locking member against the bias of the biasing means and subsequently permits said first locking member to be returned to the locked position by said biasing means such that a substantially horizontal and a substantially vertical interengagement occurs between the locking ends of the first and second locking members resulting in a supporting between the first and second locking members in a horizontal and vertical direction which precludes a disengagement of the locking ends in either a vertical direction with respect to the second locking member or a rearward direction with respect to the pivotal member.

11. A lock according to claim 10, wherein said lateral edge of one of said first and second locking members is formed as an inclined sliding surface.

12. A lock according to claim 10, wherein the lateral edges of the first and second locking members which are brought into engagement upon a closing of the pivotal member are formed as inclined sliding surfaces.

13. A lock according to claim 12, wherein the locking member engages with its locking end with the locking end of the second locking member from behind the second locking member.

* * * * *